US007090006B2

(12) United States Patent
Salama

(10) Patent No.: US 7,090,006 B2
(45) Date of Patent: Aug. 15, 2006

(54) REPLACEABLE LINER FOR METAL LINED COMPOSITE RISERS IN OFFSHORE APPLICATIONS

(75) Inventor: Mamdouh M. Salama, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/288,709

(22) Filed: Nov. 5, 2002

(65) Prior Publication Data

US 2004/0084188 A1 May 6, 2004

(51) Int. Cl.
*E21B 29/12* (2006.01)

(52) U.S. Cl. ..... 166/208; 166/277; 166/297; 138/98; 405/184.2

(58) Field of Classification Search ..... 405/184.1, 405/184.2; 166/360, 380, 381, 384, 207, 166/208, 277, 297; 138/98
See application file for complete search history.

(56) References Cited

U.S. PATENT DOCUMENTS

| | | | | |
|---|---|---|---|---|
| 2,139,745 A | | 12/1938 | Goodall | 285/80 |
| 2,661,225 A | | 12/1953 | Lyon et al. | 285/84 |
| 2,812,025 A | * | 11/1957 | Teague et al. | 166/207 |
| 3,477,506 A | * | 11/1969 | Malone | 166/207 |
| 3,489,220 A | * | 1/1970 | Kinley | 166/277 |

(Continued)

FOREIGN PATENT DOCUMENTS

| | | |
|---|---|---|
| CA | 2320028 | 3/2001 |
| EP | 0 907 049 | 4/1999 |

OTHER PUBLICATIONS

Pascinthe Saad, Ove Jahnsen, and Mamdouh M. Salama, "Application of Composites to Deepwater Top Tensioned Riser Systems," Jun. 23–28, 2002, pp. 1–7, Offshore Mechanics and Arctic Engineering.

M.M. Salama, D.B. Johnson, and J.R. Long, "Composite Introduction Riser—Testing and Qualification," Aug. 1998, pp. 170–178, SPE Production and Facilities.

Mamdouh M. Salama, Turid Storhaug, Egil Martinussen, and Ole Lindefjeld, "Application and Remaining Challenges of Advanced Composites for Water Depth Sensitive Systems," Nov. 7–9, 2000, Deep Offshore Technology 2000.

Brunswick Defense, "Design, Manufacturing, and Pricing Information for Composite Production Risers," Oct. 3, 1990, pp. 1–18, Lincoln Nebraska.

International Search Report, PCT/US 03/34618, Mar. 31, 2004, 7 pages.

"Composite Riser, Tether Could Cut TLP Displacement by 10,000 t"; Offshore, Petroleum Publishing Co.; Tulsa, US; vol. 62, No. 4; Apr. 2002; pp. 108.

Silverman S; "Drilling And Production Riser Business Poised to Grow"; Petroleum Engineer International, Hart Publications, US; vol. 72, No. 11, Nov. 1999; pp. 87–90.

International Search Report, PCT/US 03/34578, Mar. 16, 2004, 3 pages.

*Primary Examiner*—Thomas B. Will
*Assistant Examiner*—Thomas A Beach
(74) *Attorney, Agent, or Firm*—Conley Rose, P.C.

(57) ABSTRACT

A method of re-manufacturing a composite riser section having a damaged original metal liner comprises inserting an expandable replacement liner into the bore of the composite riser section and positioning the replacement liner to cover the metal liner. An annular recess may be formed circumferentially into the damaged portion of the metal liner to accommodate the replacement liner. The replacement liner is radially expanded within the composite riser section and a seal is created to prevent fluid inside the composite riser from flowing around the replacement liner, through the damaged liner, and to the outside of the composite riser.

51 Claims, 3 Drawing Sheets

U.S. PATENT DOCUMENTS

| | | | | | |
|---|---|---|---|---|---|
| 3,529,853 | A | | 9/1970 | Triest et al. | 285/149 |
| 3,768,842 | A | | 10/1973 | Ahlstone | 285/55 |
| 4,290,836 | A | | 9/1981 | McPherson et al. | 156/171 |
| 4,449,281 | A | | 5/1984 | Yoshida et al. | 29/421 R |
| 4,501,327 | A | * | 2/1985 | Retz | 166/285 |
| 4,589,801 | A | | 5/1986 | Salama | 405/224 |
| 4,634,314 | A | | 1/1987 | Pierce | 405/195 |
| 4,728,224 | A | | 3/1988 | Salama et al. | 405/195 |
| 4,745,977 | A | | 5/1988 | Love et al. | 166/369 |
| 4,875,717 | A | | 10/1989 | Policelli | 285/149 |
| 5,097,585 | A | | 3/1992 | Klemm | 29/523 |
| 5,105,854 | A | | 4/1992 | Cole et al. | 138/109 |
| 5,185,215 | A | * | 2/1993 | Adams et al. | 428/545 |
| 5,233,737 | A | | 8/1993 | Policelli | 285/390 |
| 5,348,095 | A | * | 9/1994 | Worrall et al. | 166/380 |
| 5,398,975 | A | | 3/1995 | Simmons | 285/93 |
| 5,474,132 | A | | 12/1995 | Gallagher | 166/367 |
| 5,483,894 | A | | 1/1996 | Facciano et al. | 102/293 |
| 5,487,411 | A | * | 1/1996 | Goncalves | 138/98 |
| 5,725,026 | A | * | 3/1998 | Maimets | 138/97 |
| 5,785,120 | A | * | 7/1998 | Smalley et al. | 166/55 |
| 5,813,467 | A | * | 9/1998 | Anderson et al. | 166/367 |
| 5,944,124 | A | | 8/1999 | Pomerleau et al. | 175/320 |
| 5,988,300 | A | | 11/1999 | Pomerleau et al. | 175/320 |
| 6,042,152 | A | | 3/2000 | Baldwin et al. | 285/55 |
| 6,050,612 | A | | 4/2000 | Wolterman | 285/259 |
| 6,250,385 | B1 | * | 6/2001 | Montaron | 166/207 |
| 6,405,762 | B1 | * | 6/2002 | Bunch | 138/109 |
| 6,457,532 | B1 | * | 10/2002 | Simpson | 166/380 |
| 6,561,227 | B1 | * | 5/2003 | Cook et al. | 138/98 |
| 2001/0045289 | A1 | | 11/2001 | Cook et al. | 166/380 |
| 2003/0047939 | A1 | * | 3/2003 | Whitehead et al. | 285/55 |

* cited by examiner

REPLACEABLE LINER FOR METAL LINED COMPOSITE RISERS IN OFFSHORE APPLICATIONS

CROSS-REFERENCE TO RELATED APPLICATIONS

This application is related to commonly owned U.S. Patent application Ser. No. 10/288,710, entitled "Metal Lined Composite Risers in Offshore Applications" filed on Nov. 5. 2002, which is hereby incorporated by reference herein.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The invention relates to a method of re-manufacturing a composite riser section having a damaged original metal liner. More particularly, an expandable replacement liner is installed within the bore of the composite riser section to cover the damaged portion of the original metal liner and is radially expanded to repair the composite riser section. A seal is created between the replacement liner and the composite overwrap to prevent internal fluid from flowing around the replacement liner, through the damaged metal liner and to the outside of the composite riser section.

BACKGROUND OF THE INVENTION

As exploration and production of oil and gas has moved into deeper water, it has become increasingly important to reduce weight, lower costs, and improve reliability of water-depth sensitive systems such as risers and the like. The term riser generally describes the different types of discrete pipes that extend from the seabed toward the surface of the water. These include components such as drilling risers, production risers, workover risers, catenary risers, production tubing, choke and kill lines and mud return lines. Conventional risers are typically constructed of various metal alloys such as titanium or steel. More recently, however, the oil and gas industry has considered a variety of alternative riser materials and manufacturing techniques including the use of composite materials.

Composite materials offer a unique set of physical properties including high specific strength and stiffness, resistance to corrosion, high thermal insulation, improved dampening of vibrations, and excellent fatigue performance. By utilizing these and other inherent physical characteristics of composite materials, it is believed that composite riser may be used to lower system costs and increase reliability of risers used in deepwater applications. Although there has been a significant effort in the last decade to facilitate and to increase the general use of composites in offshore applications, the acceptance of composite materials by offshore operators continues to be a relatively slow and gradual process. Reasonably good progress has been made to expand the usage of composites for topside components such as vessels, piping and grating. Some advanced components such as high-pressure riser accumulator bottles have already been used successfully in the field. However, in view of the reduced weight, extended life span, lower cost and other enabling capabilities, composite risers are particularly appealing for deep water drilling and production operations.

Composite risers are generally constructed of a number of riser sections each having an outer composite material and an inner liner assembly. Typically, a thin tubular metal or elastomeric liner is coaxially secured to the metal connections at opposite ends to form the liner assembly. For a liner assembly comprising a metal liner, an elastomeric shear ply (usually rubber) is provided along the outer surface of the liner assembly, followed with a composite overwrap reinforcement to form the composite riser section. The composite riser section is then heated to cure the elastomeric shear ply and the composite overwrap. Additionally, an external elastomeric jacket and a layer of composite overwrap may be provided over the composite riser section and thermally cured to reduce external damage by providing impact protection and abrasion resistance to the composite riser section.

The liner assembly is necessary to prevent leakage due to the inherent cracking characteristics of the composite material. Typically, the matrix of the composite overwrap will develop micro cracks at pressures lower than those at which the reinforcing fibers of the composite structure will fail. Matrix micro cracking is due to the thermal stresses induced by the curing cycle and the mechanical stresses induced during the shop acceptance pressure test of the composite riser section during the manufacturing process. Thus, the liner assembly is essential in ensuring fluid tightness of a composite riser to prevent leakage under the condition of matrix micro cracking which is expected.

While elastomeric liners are generally acceptable for production composite risers, they are ill suited for use in composite drilling or workover risers. The likely possibility of damaging, namely cutting or tearing, elastomeric liners with the mechanical tools required for drilling and workover operations makes elastomeric liners less desirable for these types of operations. Accordingly, metal liners for composite drilling and workover risers are being considered. Metal liners also have applications in composite production risers as the metal liners may offer better long term resistance the corrosive production fluids than most elastomeric liners. In a typical composite riser having a metal liner, the metal liner is welded directly to the metal connection assembly at or near the metal-to-composite interface (MCI). Alternatively, the metal liner may be coaxially secured to the MCI through the use of a transition ring. The transition ring is secured at one end to the MCI and is welded at the other end to the metal liner and serves as a transition between the material of the liner and that of the MCI. A transition ring is generally used because the MCI and the connection assembly are generally constructed of a heavier tube stock than the relatively thin metal liner which serves primarily to keep the composite riser from leaking internal fluid. The transition ring is secured to the MCI either by welding or mechanically attaching it to the MCI. A mechanical attachment is preferred over welding when the transition ring and the MCI are formed of different materials.

SUMMARY OF THE INVENTION

The invention provides a cost effective alternative to replacing an entire composite riser section when only the liner of the riser section is damaged by disclosing a method of re-manufacturing a composite riser section, particularly in a composite drilling or workover riser. An expandable replacement liner is inserted into the bore of the composite riser section and is positioned to cover the damaged portion of the original liner. The damaged metal liner of the composite riser section may be machined away to form an annular recess between the ends of the liner. The replacement liner is positioned within the annular recess of the damaged metal liner to ensure proper alignment of the replacement liner. The depth of the annular recess can be substantially the same as the thickness of the replacement liner for forming a relatively smooth or flush inner surface in the composite riser section with the replacement liner installed therein.

The replacement liner is held in position as it is radially expanded to an outer diameter which is slightly less than the inner diameter of the composite overwrap and slightly larger than the inner diameter of the elastomeric shear ply. This will allow for an interference fit (i.e. auto-frettage) between the replacement liner and the repaired riser section. Note that if the damaged portion of the liner is not removed to form an annular recess, the replacement liner should be expanded to form an interference fit with the original metal liner itself. Of course, making the repair without removing the damaged portion of the original liner will slightly decrease the inner diameter of the composite riser section.

By way of example only, one end of the replacement liner can be attached to the inside of the composite riser section for holding the replacement liner in place as it is expanded. Alternatively, a plug can be inserted in the bore of the composite riser section proximate one end of the replacement liner to hold it in position as it is being expanded. In addition, one or both ends of the replacement liner can be mechanically flared or expanded at the ends to engage the inner surface of the composite riser section when the replacement liner is positioned over the liner.

Radial expansion of the replacement liner within the composite riser section can be accomplished by the use of an expansion tool having a diameter larger than the inner diameter of the unexpanded liner. The expansion tool is axially moved through the liner to expand the liner to the diameter of the expansion tool which is preferably just slightly larger than the inner diameter of the elastomeric shear ply of the composite riser section. The expansion tool may have rollers set in tension for rolling along the inner surface of the replacement liner as the tool is moved axially through the liner to ensure that the outer surface of the replacement liner conforms to the contours of the inner surface of the composite riser section.

As the outer diameter of the replacement liner is expanded toward the dimension of the inner diameter of the composite overwrap, interface pressure between the outer surface of the replacement liner and the inner surface of the elastomeric shear ply creates a seal therebetween. The seal prevents internal fluid from leaking around the replacement liner, through the damaged portion of the original liner and to the outside of the composite riser. A seal may also be created by applying a sealant, such as an epoxy resin or other suitable adhesive compound, at the ends of the replacement liner between the replacement liner and the damaged metal liner. Alternatively, a sealant can be applied to the inner surface of the elastomeric shear ply or to the outer surface of the replacement liner for creating a seal between the replacement liner and the shear ply as their surfaces come into contact.

BRIEF DESCRIPTION OF THE DRAWINGS

The present invention will be better understood in view of the detailed description in conjunction with the following drawings in which like reference numbers refer to like parts in each of the figures, and in which.

DETAILED DESCRIPTION

Figure 1:
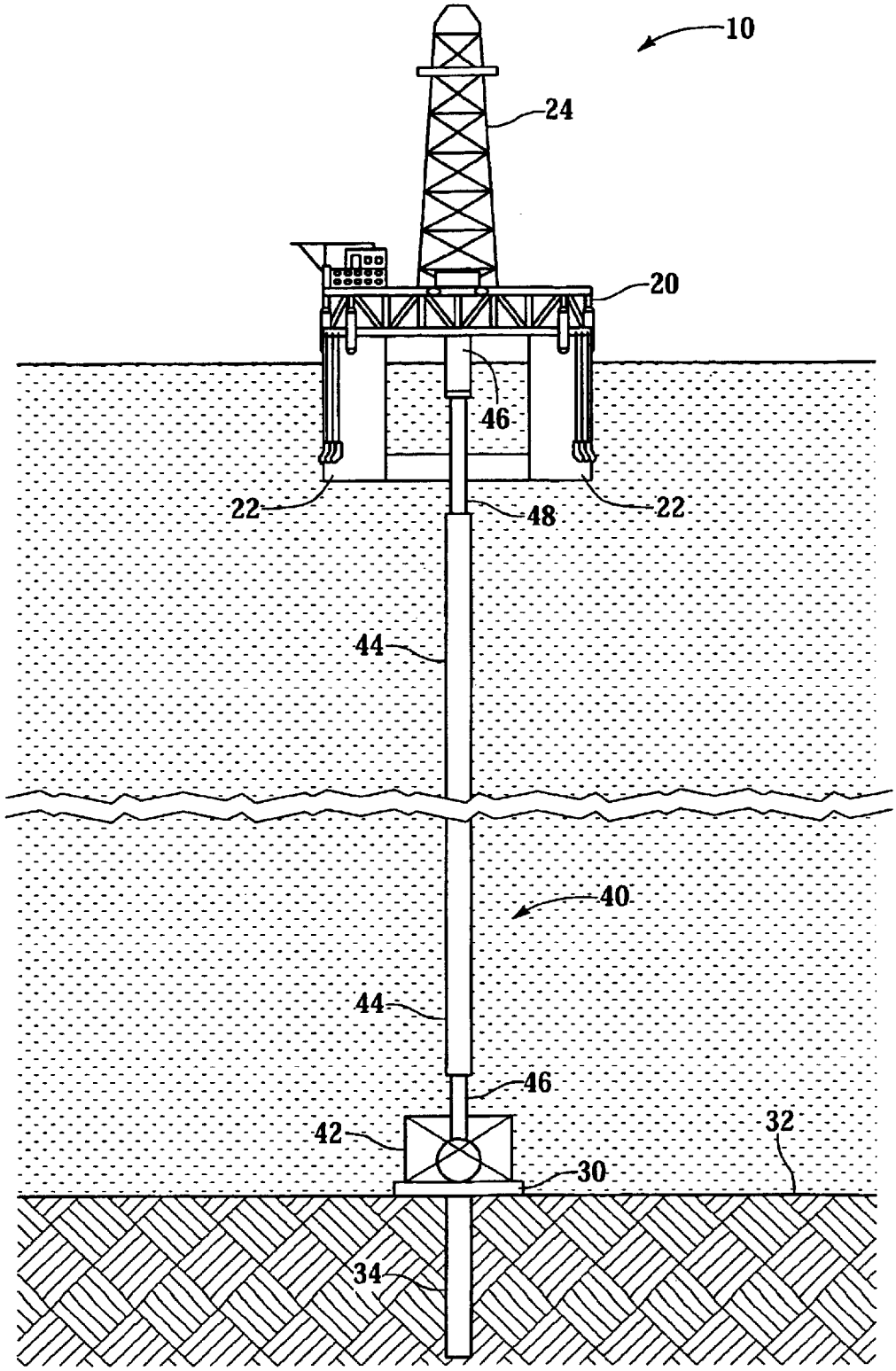
FIG. 1 is an elevational view of a simplified schematic of an offshore drilling and production assembly.

FIG. 1 is a simplified schematic drawing of a conventional offshore drilling and production assembly [10] illustrating the context of the present invention. An offshore platform [20] supports derrick [24] which is a conventional apparatus for drilling or working over a borehole [34] and producing hydrocarbons from the borehole [34]. Offshore platform [20] is supported by pontoons [22]. A subsea template [30] is provided on the floor of the sea [32] and the borehole [34] extends downward from the sea floor [32].

A conventional elongated riser [40] extends between the subsea template [30] and the platform [20]. The riser [40] generally comprises a tieback connector [42] proximate to the borehole [34] and a number of riser sections [44] which extend between platform [20] and subsea template [30] and are connected thereto by a taper or flex joint [46] and telescoping section [48] to accommodate the movement of the platform [20] relative to the subsea template [30] and the borehole [34]. The elongated riser sections [44] which comprise conventional riser [40] are coaxially secured together in series. Each riser section [44] must accommodate the pressure of the fluid or gas within the section, the tensile load which is caused by the suspension of additional riser sections [44] below the section, the tensioner load and the bending moments imposed by the wave loads and the relative movement of the platform [20] with respect to the subsea template [30].

Figure 2:
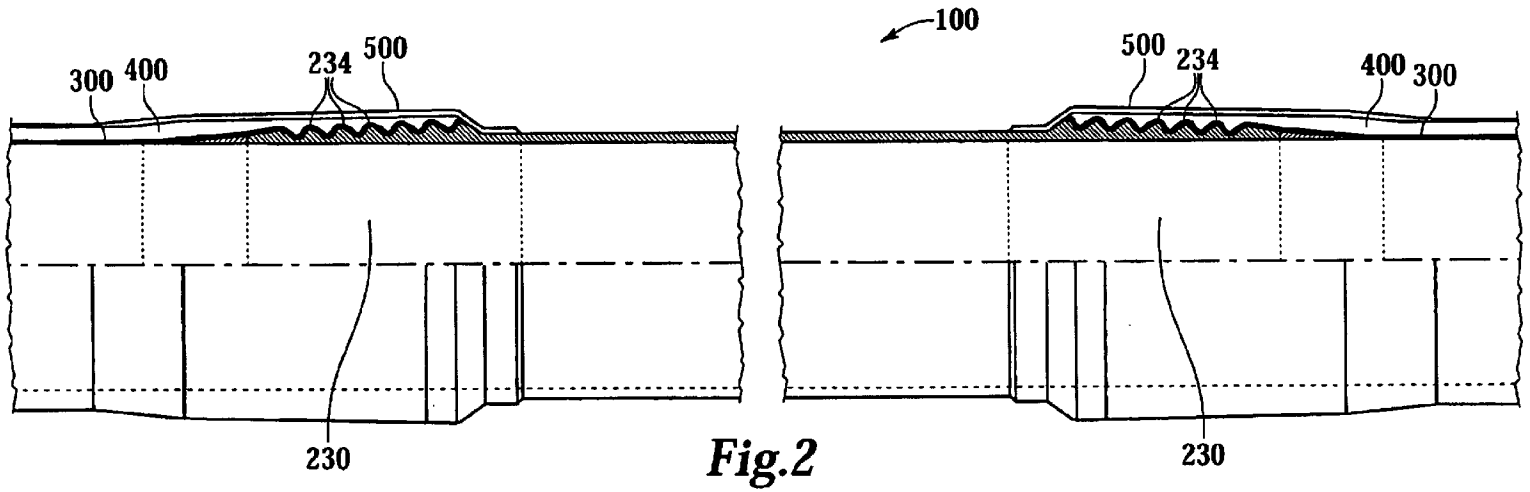
FIG. 2 is a cut-away elevational view of a metal-lined composite riser section having a traplock-type MCI.

In a composite riser, metal connectors are coaxially secured to liners to form a liner assembly which is wrapped with an elastomeric shear ply, a composite overwrap reinforcement, an external elastomeric jacket and an outer-wrap for impact and external damage protection. The liners can be metal or elastomeric, depending on the particular application of the composite riser as production, drilling or workover risers. FIG. 2 shows a cross-sectional view of a metal-lined composite riser section [100]. A metal-to-composite interface (MCI) [230] comprises a plurality of outer grooves [234] which are illustrated in a trap lock configuration, although configurations other than a trap lock configuration may be used. Each groove [234] is a mechanical interlock joint which is fabricated into the outer surface of MCI [230]. An elastomeric shear ply [300] in an uncured state is applied to the outer surface of liner assembly [102] to provide an interface between the liner assembly [102] and structural composite overwrap [400]. A thinner elastomeric shear ply interface over outer grooves [234] allows the surface of the grooves [234] and the shear ply [300] to move relative to the structural composite overwrap [400]. The structural composite overwrap [400] is essentially a load-bearing composite tube of carbon, glass or other reinforcing fibers embedded in an epoxy matrix which is fabricated over the metal liner assembly [102]. Heat is applied to cure the thermosetting matrix of composite overwrap [400] and the elastomeric shear ply [300].

After curing, an external jacket [500] of an uncured elastomeric material may be applied over the entire length of the resulting composite riser section [100] to prevent migration of seawater into the composite wall and through its interface with the MCI. An outerwrap (not shown) comprising a composite of carbon, glass or other reinforcing fibers in an epoxy resin matrix can be filament wound over the external elastomeric jacket [500] to compact the jacket and to provide scuff protection. The composite riser section is then heated and held at a suitable temperature to cure elastomeric external jacket [500] and the outerwrap.

Figure 3:
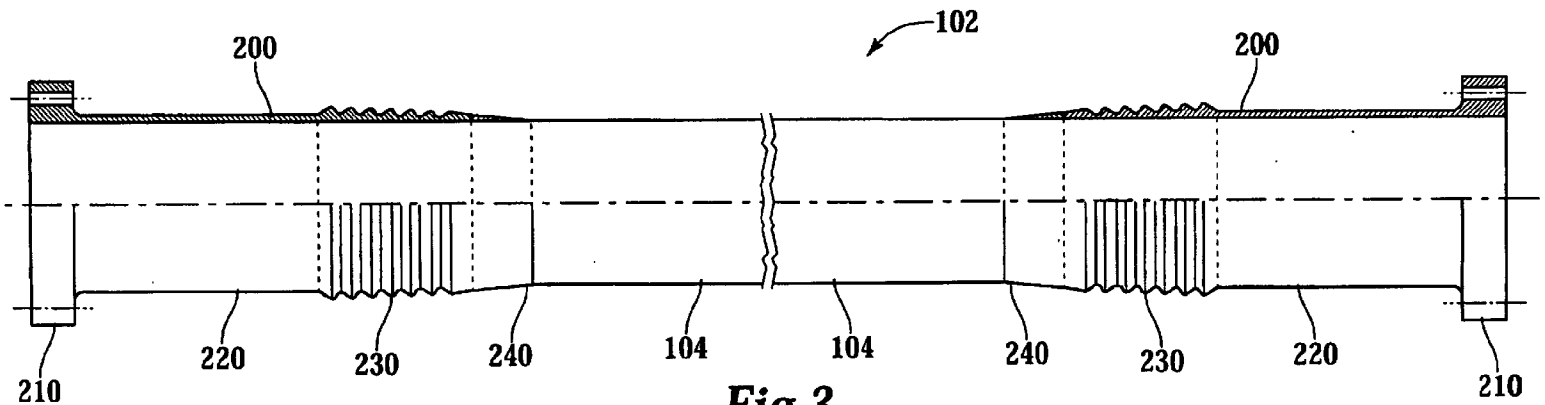
FIG. 3 is a cut-away elevational view of a metal liner assembly for use in a composite riser section.

Referring now to FIG. 3, a metal liner assembly [102] for a composite riser section [100] comprises a connection assembly [200] proximate each end of a tubular section of liner [104]. Each connection assembly [200] comprises a mechanical connector such as a flange [210], an MCI [230] and a tubing section [220] which provides an offset between the flange [210] and MCI [230]. As shown here, the metal liner assembly [102] also has a transition ring [240] that is coaxially secured between the MCI [230] and the metal liner section [104]. The transition ring [240] can be coaxially secured by welding its ends to MCI [230] and liner section [104] or, alternatively, can be fabricated from a continuous tubular joint with the MCI [230] or with the liner [104]. As noted earlier, the transition ring [240] serves to connect and transfer applied loads from the relatively thin metal liner [104] to the heavier tube stock of the connection assembly [200] near the MCI [230].

Figure 4:
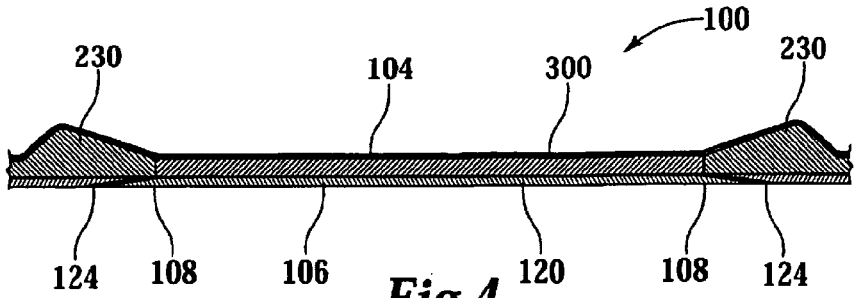
FIG. 4 is a cross-sectional view of a portion of a metal-lined composite riser section with a replacement liner installed therein.
Figure 5:
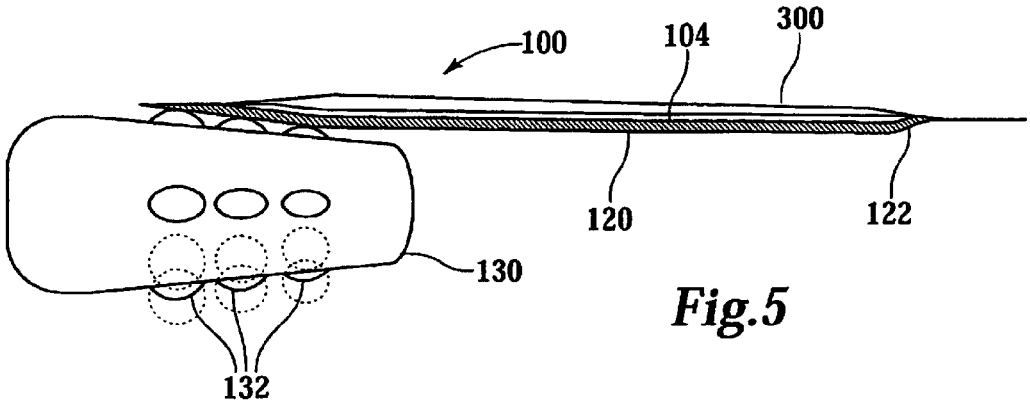
FIG. 5 is a cross-sectional view of a portion of a metal-lined composite riser section with a replacement liner and tool for expanding the replacement liner.

Referring now to FIG. 4, an expandable replacement liner [120] is inserted in its unexpanded state in the bore of composite riser section [100] and positioned to cover the damaged metal liner [104]. To hold replacement liner [120] in position over the damaged liner [104] as it is being expanded, replacement liner [120] can be attached at one of its ends to the inside of composite riser section [100]. One or both ends [122] of replacement liner [120] can be mechanically flared or expanded to engage the inner surface of composite riser section [100] to hold replacement liner [120] in position, as shown in FIG. 5. Alternatively, a plug (not shown) can be inserted into the bore of composite riser section [100] proximate to one end of replacement liner [120] to hold the liner in position as it is being expanded.

As illustrated in FIG. 4, the damaged metal liner [104] of composite riser section [100] can be machined away to form an annular recess [106] proximate the ends of liner [104]. The replacement liner [120] is positioned within the annular recess [106] to cover liner [104]. The thickness of replacement liner [120] and the depth of annular recess [106] can be substantially the same dimension to form a relatively flush inner surface of the composite riser section [100] when replacement liner [120] is positioned within annular recess [106]. The ends [108] of the annular recess [106] may be tapered toward MCI [230] to allow relatively easy positioning of the replacement liner [120] within annular recess [106] and over the damaged liner [104].

Figure 7:
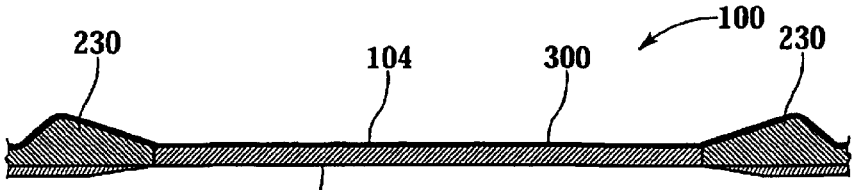
FIG. 7 is a cross-sectional view of a portion of a metal-lined composite riser section with the liner portion cut and removed.

The present invention is also suitable for a composite riser section [100 ] having a damaged expandable replacement liner [120], In this embodiment, the damaged expandable liner [120] would be removed by making one or more longitudinal cuts axially along the damaged expandable liner [120], and removing the damaged liner [120] to expose the annular recess [106], for example, as shown in FIG. 7. The removed expandable liner [120] would then be replaced as described herein with another expandable replacement liner [120] to fill the recess [106] and again form the re-manufactured composite riser [100] as shown in FIG. 4. Similarly, the present invention also allows for placing a relatively short length of liner over a damaged portion of the riser section and expanding it. Note that if the whole length is to be covered, access to the ends of the liner will make the process of sealing the liner against the surface of the metal connector easier.

Still referring to FIG. 5, replacement liner [120] is positioned within the bore of composite riser section [100] and is radially expanded to an outer diameter which is about the same as or slightly larger than the inner diameter of elastomeric shear ply [300] of the composite riser section [100]. Radial expansion of replacement liner [120] can be assisted by cooling the replacement liner [120] in its unexpanded state prior to insertion into the bore of composite riser section [100] and then heating replacement liner [120] when it is positioned over the damaged liner [104]. By way of example only, for a replacement liner [120] having an outer diameter of 10.000 inches at room temperature, cooling the replacement liner [120] by about 100 F should reduce the outer diameter to 9.994 inches. It is usually sufficient heating to expand the liner by simply bringing the replacement liner [120] back to room temperature after insertion into the damaged composite riser section [100].

Radial expansion of replacement liner [120] is completed by the use of an expansion tool [130], for example, an expansion mandrel, which is axially moved through replacement liner [120]. Expansion tool [130] should have a diameter larger than the inner diameter of the unexpanded replacement liner [120] and preferably about the same as the desired inner diameter of the remanufactured composite riser section [100]. Expansion tool [130] can be tapered in the direction of movement, its largest diameter being greater than the inner diameter of the unexpanded replacement liner [120] and about the same as the desired inner diameter of the remanufactured composite riser section [100]. As expansion tool [130] is moved through replacement liner [120], the tool [130] axially expands liner [120] to an inner diameter which is about the same as the largest outer diameter of the tool [130]. The replacement liner [120] expansion can also be accomplished with hydraulic pressure applied to a moving pig. However, this method is generally more suitable for an installation in which the replacement liner extends along the whole length of the riser section.

Still referring to FIG. 5, in a further embodiment, expansion tool [130] has rollers [132] positioned circumferentially around the tool. The diameter of expansion tool with the rollers is preferably about the same as the desired inner diameter of the remanufactured composite riser section [100]. Rollers [132] are set to induce a force sufficient to expand replacement liner [120] by rolling along the inner surface of replacement liner [120] as expansion tool [130] is axially moved through replacement liner [120]. The rollers [132] can be actuatable, for example hydraulically or mechanically, to change the outer diameter of the expansion tool [130] and to allow a larger clearance between the expansion tool and the inner surfaces of composite riser section [100] and replacement liner [120] as the expansion tool is inserted into the bores. For example, rollers [132] can be held close to the surface of expansion tool [130] as it is being inserted into the bore of composite riser section [100] and then actuated radially outward from the surface of expansion tool [130] to engage the inner surface of replacement liner [120] for expansion thereof. The range that the rollers [132] may be actuated radially outward is represented by dashed lines in FIG. 5. Expansion tool [130] can be rotated as it is axially moved through replacement liner [120] to engage rollers [132] against the surface of replacement liner [120] to expand the liner. The rollers [132] should be set at a sufficient preload to conform the outer surface of the replacement liner [120] to the contours of the inner surface of composite riser section [100]. If there is a gap between the ends of the expanded replacement liner [120] and MCI [230], a high temperature sealant, such as an epoxy resin, can be used to fill the gap.

Referring back to FIG. 4, as the outer diameter of replacement liner [120] is radially expanded toward the dimension of the inner diameter of composite riser section [100] and the outer surface of replacement liner [120] contacts the inner surface of the structural composite overwrap [400], interface pressure between the surfaces is created. The interface pressure forms a seal (not shown) between replacement liner [120] and composite overwrap [400]. The seal prevents internal fluid from leaking around ends [122] of replacement liner [120], through the damaged metal liner [104] and to the outside of composite riser section [100]. An adhesive can be applied proximate ends [122] of replacement liner [120] to create seals [124] between replacement liner [120] and composite riser section [100]. Alternatively, an adhesive can be applied to the inner surface of composite overwrap [400] or to the outer surface of replacement liner [120] for sealing therebetween as the surfaces come into contact.

Figure 6:
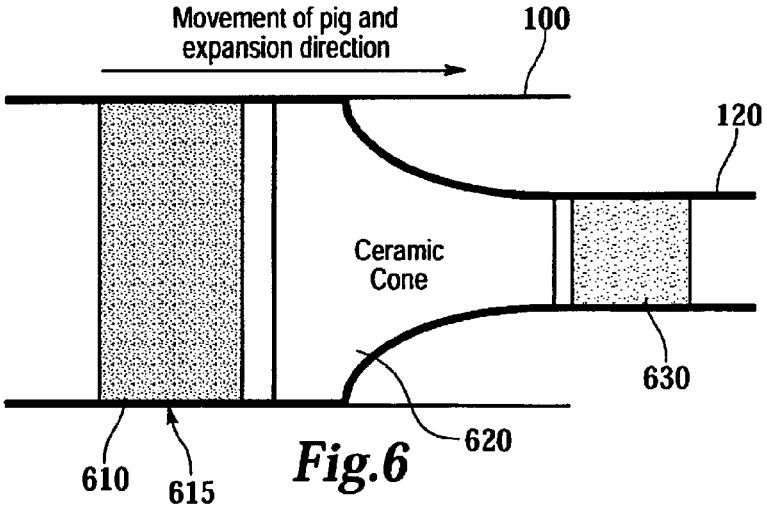
FIG. 6 is a cross-sectional view of a portion of a metal-lined composite riser section with a replacement liner, a pig and a shaping cone for hydraulically expanding the replacement liner.

Referring now to FIG. 6, in yet another embodiment, the expansion process may be carried out using a pig [610] that pushes a solid shaping cone [620] having a maximum outer diameter slightly less than the inner diameter of the composite riser section, not shown. The shaping cone [620] has a smooth, tapered exterior and may be formed of any number of suitable materials which can expand the metal replacement liner [120] without cutting, scratching or damaging it. By way of example only, in one embodiment the shaping cone [620] may be formed of a ceramic material. In use, the pig [610] is propelled forward axially along the riser section by hydraulic pressure that is induced with pressurized fluid. The pig [610] has seals [615] about its circumference to prevent the fluids behind the pig [610] from leaking forward and equilibrating the pressure and slowing or impeding the movement of the pig [610]. As shown here, a grease plug [630] may also be used to lubricate the replacement liner [120] as it is expanded and to further seal the portion of the replacement liner [120] being expanded to maintain a sufficient pressure differential in front of and behind the pig [610]. Although these types of pigs are generally known in the oil and gas industry and are commonly used for cleaning various pipelines, it is believed that a pig has not previously been used to propel a shaping cone [620] to expand a metal liner within a composite riser section [100] or to re-manufacture one that has been damaged.

While a number of preferred embodiments of the invention have been shown and described herein, modifications may be made by one skilled in the art without departing from the spirit and the teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed:

1. A method of re-manufacturing a composite riser section lined with a metal liner having a damaged portion, comprising the steps of:

installing a replacement liner within the bore of the composite riser section; and radially expanding said replacement liner into direct contact with the composite riser section via the damaged portion of the metal liner, wherein the replacement liner is radially expanded to engage a structural composite overwrap of the composite riser section.

2. The method of claim 1 wherein said replacement liner is installed as a patch to cover the damaged portion of the metal liner.

3. The method of claim 1 wherein said replacement liner is installed to cover the entire length of the metal liner.

4. A method of re-manufacturing a composite riser section with a metal liner having a damaged portion, comprising the steps of:

installing a replacement liner within the bore of the composite riser section radially expanding said replacement liner within the composite riser section and cutting and removing the metal liner having a damaged portion prior to installing the replacement liner.

5. The method of claim 1 further comprising sealing said replacement liner to the composite riser section.

6. The method of claim 1 further comprising sealing the ends of said replacement liner to the composite riser section.

7. A composite riser section re-manufactured according to the method of claim 1.

8. The method of claim 5 wherein the sealing step comprises creating interface pressure between the replacement liner and the composite riser section.

9. The method of claim 5 wherein the sealing step comprises applying an adhesive between the replacement liner and the composite riser section.

10. The method of claim 6 wherein the sealing step comprises applying an adhesive proximate the ends of said replacement liner.

11. A method of re-manufacturing a composite riser section With a metal liner having a damaged portion, comprising the steps of:

installing a replacement liner within the bore of the composite riser section and radially expanding said replacement liner within the composite riser section;

wherein laid replacement liner is installed in the composite riser section by cooling said replacement liner, inserting said replacement liner in the composite riser section and heating said replacement liner for radial expansion thereof.

12. A composite riser section re-manufactured according to the method of claim 11.

13. The method of claim 1 wherein said replacement liner is radially expanded using an expansion tool having an outer diameter larger than the inner diameter of the replacement liner in its unexpanded state, wherein said expansion tool is axially moved through said replacement liner for expansion thereof.

14. The method of claim 13 wherein said expansion tool is a shaping cone that is moved axially through the replacement liner by a pig.

15. The method of claim 14 wherein said shaping cone is formed of a ceramic material.

16. The method of claim 14 wherein the pig is moved axially through the replacement liner by hydraulic forces.

17. The method of claim 13 wherein said expansion tool is provided with roller along its surface for rolling along the inner surface of said replacement liner as said tool is rotated and axially moved through said replacement liner.

18. The method of claim 17 wherein the rollers may be actuated to change the outer diameter of the shaping tool.

19. A composite riser section re-manufactured according to the method of claim 17.

20. The method of claim 14 further comprising lubricating the replacement liner as the shaping cone is moved axially through the replacement liner by the pig.

21. The method of claim 14 further comprising maintaining a pressure differential in front of and behind the pig.

22. The method of claim 17 further comprising preloading the rollers to induce a force sufficient to expand the replacement liner.

23. The method of claim 18 wherein the rollers are actuated mechanically.

24. The method of claim 18 wherein the rollers are actuated hydraulically.

25. A method of re-manufacturing a composite riser section having a metal liner having a damaged portion, comprising the steps of:

forming an annular recess circumferentially along the inner surface of the composite riser section between the ends of the liner;

positioning a radially expandable replacement liner within said annular recess of the composite riser section; and radially expanding said replacement liner within the composite riser section.

26. The method of claim 25 wherein said replacement liner is installed in the composite riser section by cooling said replacement liner, inserting said replacement liner in the composite riser section and heating said replacement liner for radial expansion thereof.

27. The method of claim 25 further comprising sealing said replacement liner to the composite riser section.

28. The method of claim 25 further comprising sealing the ends of replacement liner to the composite riser section.

29. A composite riser section re-manufactured according to the method of claim 25.

30. The method of claim 25 wherein said replacement liner is radially expanded using an expansion tool having a diameter larger than the inner diameter of the replacement liner in its unexpanded state, wherein said expansion tool is axially moved through said replacement liner for expansion thereof.

31. The method of claim 30 wherein said expansion tool is provided with rollers along its surface for rolling along the inner surface of said replacement liner as said tool is rotated and axially moved through said replacement liner.

32. The method of claim 31 wherein the rollers may be actuated to change the outer diameter of the shaping tool.

33. The method of claim 30 wherein said expansion tool is a shaping cone that is moved axially through the replacement liner by a pig.

34. The method of claim 33 wherein the shaping cone is formed of a ceramic material.

35. The method of claim 33 wherein the pig is moved axially through the replacement liner by hydraulic forces.

36. A composite riser section re-manufactured according to the method of claim 30.

37. The method of claim 25 wherein the replacement liner is radially expanded to engage a structural composite overwrap of the composite riser section.

38. The method of claim 25 wherein the radially expanding step substantially maintains an original internal diameter of the composite riser section.

39. A composite riser section re-manufactured according to the method of claim 26.

40. The method of claim 27 wherein the sealing step comprises creating interface pressure between the replacement liner and the composite riser section.

41. The method of claim 27 wherein the sealing step comprises applying an adhesive between the replacement liner and the composite riser section.

42. The method of claim 28 wherein the scaling step comprises applying an adhesive proximate the ends of said replacement liner.

43. The method of claim 31 further Comprising preloading the rollers to induce a force sufficient to expand the replacement liner.

44. The method of claim 32 wherein the rollers are actuated mechanically.

45. The method of claim 32 wherein the rollers are actuated hydraulically.

46. The method of claim 33 further comprising lubricating the replacement liner as the shaping cone is moved axially through the replacement liner by the pig.

47. The method of claim 33 further comprising maintaining a pressure differential in front of and behind the pig.

48. A method of re-manufacturing a composite riser section lined with a metal liner having a damaged portion, comprising the steps of:

Installing a replacement liner within the bore of the composite riser section; and radially expanding said replacement liner into direct contact with the composite riser section via the damaged portion of the metal liner, wherein the radially expanding step reduces an original internal diameter of the composite riser section.

49. The method of claim 48 wherein the replacement liner is radially expanded to engage a shear ply or a structural composite overwrap of the composite riser section.

50. A method of re-manufacturing a composite riser section lined with a metal liner having a damaged portion comprising the steps of:

installing a replacement liner within the bore of the composite riser section; and radially expanding said replacement liner into direct contact with the composite riser section via the damaged portion of the metal liner, wherein the radially expanding step substantially maintains an original internal diameter of the composite riser section.

51. The method of claim 50 wherein the replacement liner is radially expanded to engage a shear ply or a structural composite overwrap of the composite riser section.

* * * * *

UNITED STATES PATENT AND TRADEMARK OFFICE

CERTIFICATE OF CORRECTION

PATENT NO. : 7,090,006 B2
APPLICATION NO. : 10/288709
DATED : August 15, 2006
INVENTOR(S) : Mamdouh M. Salama It is certified that error appears in the above-identified patent and that said Letters Patent is hereby corrected as shown below:

Column 8, line 46, please delete "With" and insert --with--
Column 8, line 52, please delete "laid" and insert --said--
Column 9, line 6, please delete "roller" and insert --rollers--
Column 10, line 24, please delete "Comprising" and insert --comprising--

Signed and Sealed this

Sixteenth Day of January, 2007

JON W. DUDAS
*Director of the United States Patent and Trademark Office*